United States Patent [19]

Cohrs

[11] Patent Number: 4,974,890

[45] Date of Patent: Dec. 4, 1990

[54] UNIVERSAL ASSEMBLY FOR TOP AND BOTTOM LATCHES, IN VERTICAL-ROD EXIT DEVICES, AND TOP AND BOTTOM LATCHES FOR SUCH DEVICES

[75] Inventor: Richard B. Cohrs, Indianapolis, Ind.

[73] Assignee: Von Duprin, Inc., Indianapolis, Ind.

[21] Appl. No.: 369,803

[22] Filed: Jun. 22, 1989

[51] Int. Cl.[5] ..... E05C 5/02

[52] U.S. Cl. ..... 292/336.3; 292/DIG. 54

[58] Field of Search ..... 292/336.3, 36, 21, 92, 292/DIG. 27, 244, 167, 223, DIG. 54

[56] References Cited

U.S. PATENT DOCUMENTS 3,137,518 6/1964 Dale ..... 292/36
3,334,500 8/1967 Bejarano ..... 292/21 X
3,621,686 11/1971 Klein ..... 292/167 X
4,422,677 12/1983 Gater ..... 292/167 X

*Primary Examiner*—Richard E. Moore
*Attorney, Agent, or Firm*—Walter C. Vliet; Bernard J. Murphy

[57] ABSTRACT

The universal assembly comprises components and parts interchangeable between, for being common to, a top latch and a bottom latch in vertical-rod exit devices. Simply by adding a few discrete parts to the assembly, the same becomes, selectively, a top latch or a bottom latch, The top latch, and the bottom latch, comprise the universal assembly to which the respective, discrete parts have been added. The assembly, and the latches have a rotatable input member with must be rotated to enable retraction of a latch bolt, and a limb operative to block retraction of a latch bolt if the input member is not rotated.

11 Claims, 3 Drawing Sheets

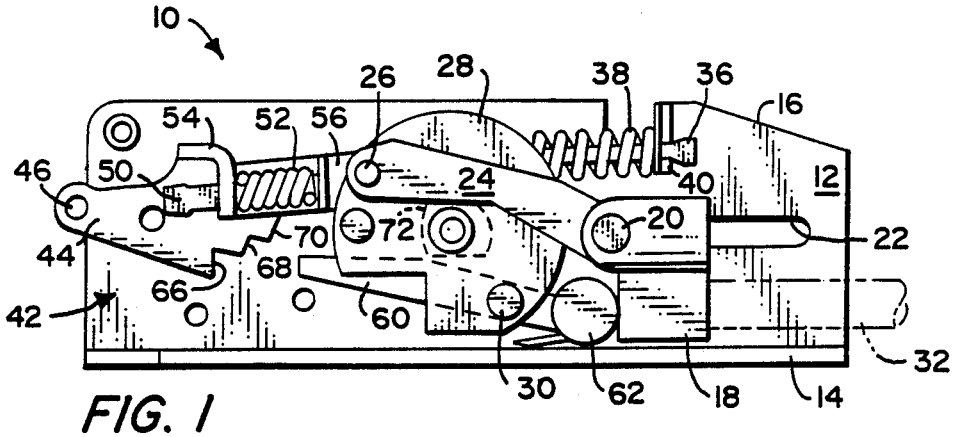
FIG. 1
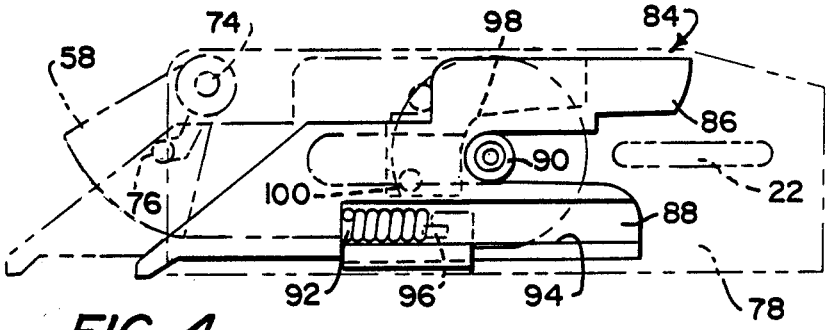
FIG. 4
FIG. 5
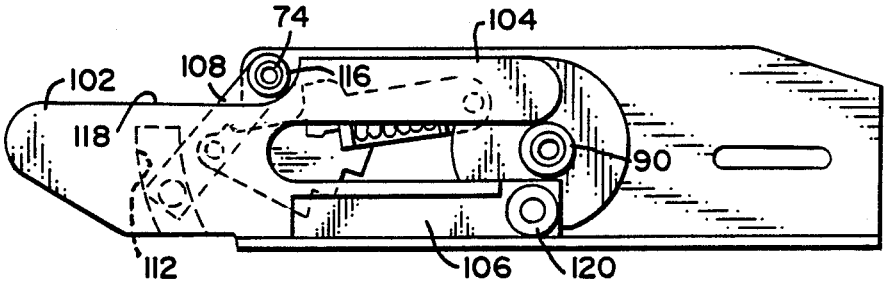

UNIVERSAL ASSEMBLY FOR TOP AND BOTTOM LATCHES, IN VERTICAL-ROD EXIT DEVICES, AND TOP AND BOTTOM LATCHES FOR SUCH DEVICES

This invention pertains to vertical rod exit devices, and in particular to top and bottom latches for such devices, as well as to a universal assembly of components and parts interchangeable between, for being common to, a top latch and a bottom latch in such devices.

Vertical-rod exit devices come in two versions: surface-mounted, and concealed. In addition, some exit devices pull down, on the rod attached to the top latch, while others push up on that rod, to cause retraction of the latch bolts in both latches. Also, of course, the top and bottom latches are differently composed and, consequently, it is necessary to stock a great number of parts and components to provide exit devices which meet all the functions and versions thereof.

In view of the aforesaid, it is greatly desirable that there be a universal assembly which is useful for either a top latch, or a bottom latch, and which can be operated by having the attached rod pushed or pulled to effect actuation thereof.

It is an object of this invention to set forth just such a universal assembly, as well as top and bottom latches incorporating the novel assembly.

Particularly, it is an object of this invention to set forth a universal assembly for top or bottom latches, in vertical-rod exit devices, comprising a platform; an input member rotatably journalled on said platform; a rod connector slidably supported on said platform for translation in opposite directions; means linking said rod connector and said input member for causing rotation of said input member coincident with slidable movement of said rod connector; a linkage subassembly coupled to said input member, and having means for engaging a latch bolt, for moving such a latch bolt pursuant to coincident (a) rotation of said input member, and (b) movement of said subassembly; and means movably coupled to said platform for blocking movement of said subassembly in response to a movement of such an engaged latch bolt independent of rotation of said input member.

Further objects of this invention, as well as the novel features thereof, will become more apparent by reference to the following description, taken in conjunction with the accompanying figures, in which:

FIG. 1 is a vertical illustration of the novel universal assembly, in which the side plate of the platform has been omitted for clarity of illustration.

FIG. 4 illustrates the relationship of the auxiliary bolt to the latch bolt and the universal assembly, in the top latch; and FIG. 5 depicts the emplacement of the latch bolt, in relation to the universal assembly, in the bottom latch.

Figure 2:
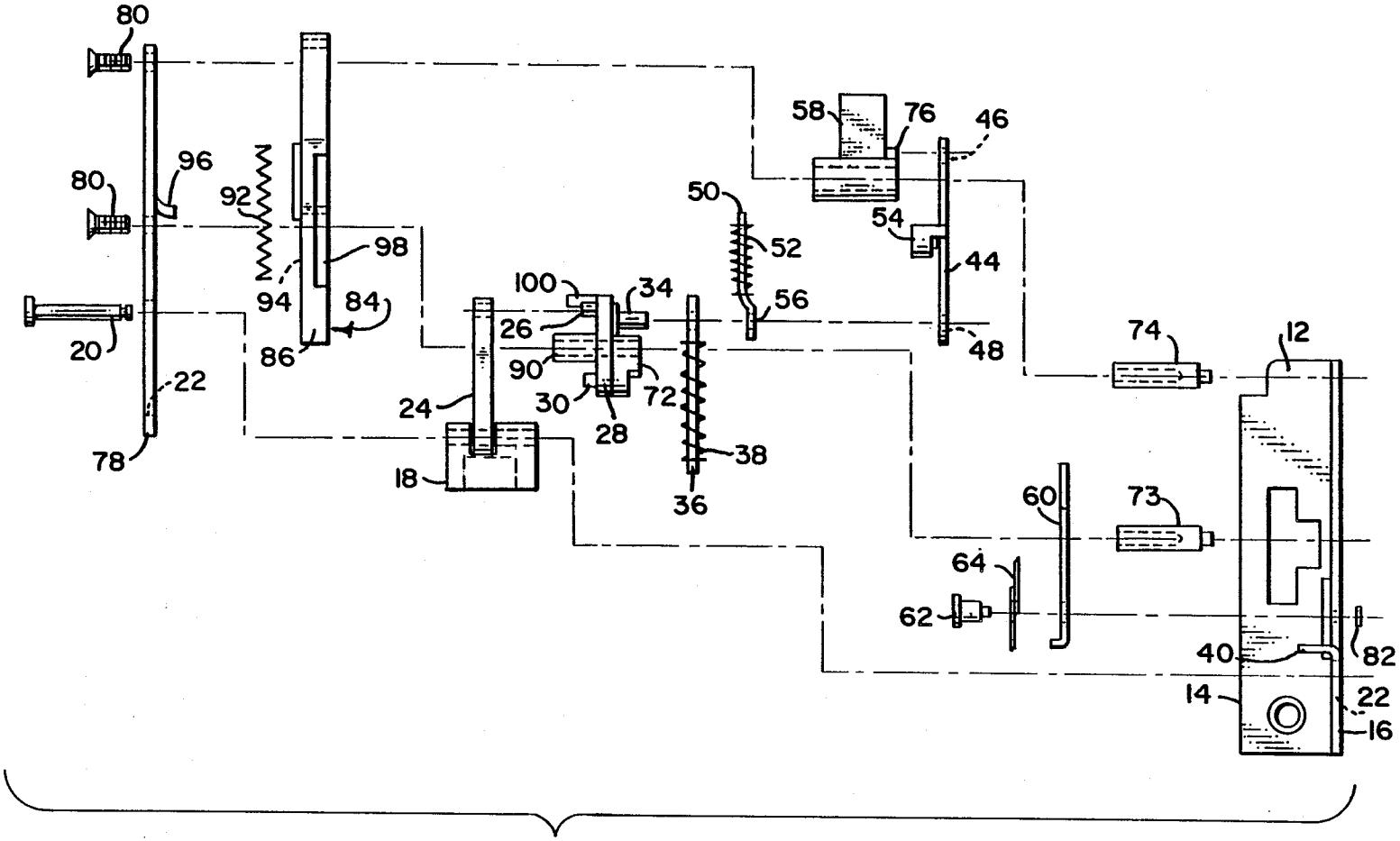
FIG. 2 is an exploded view of the top latch.
Figure 3:
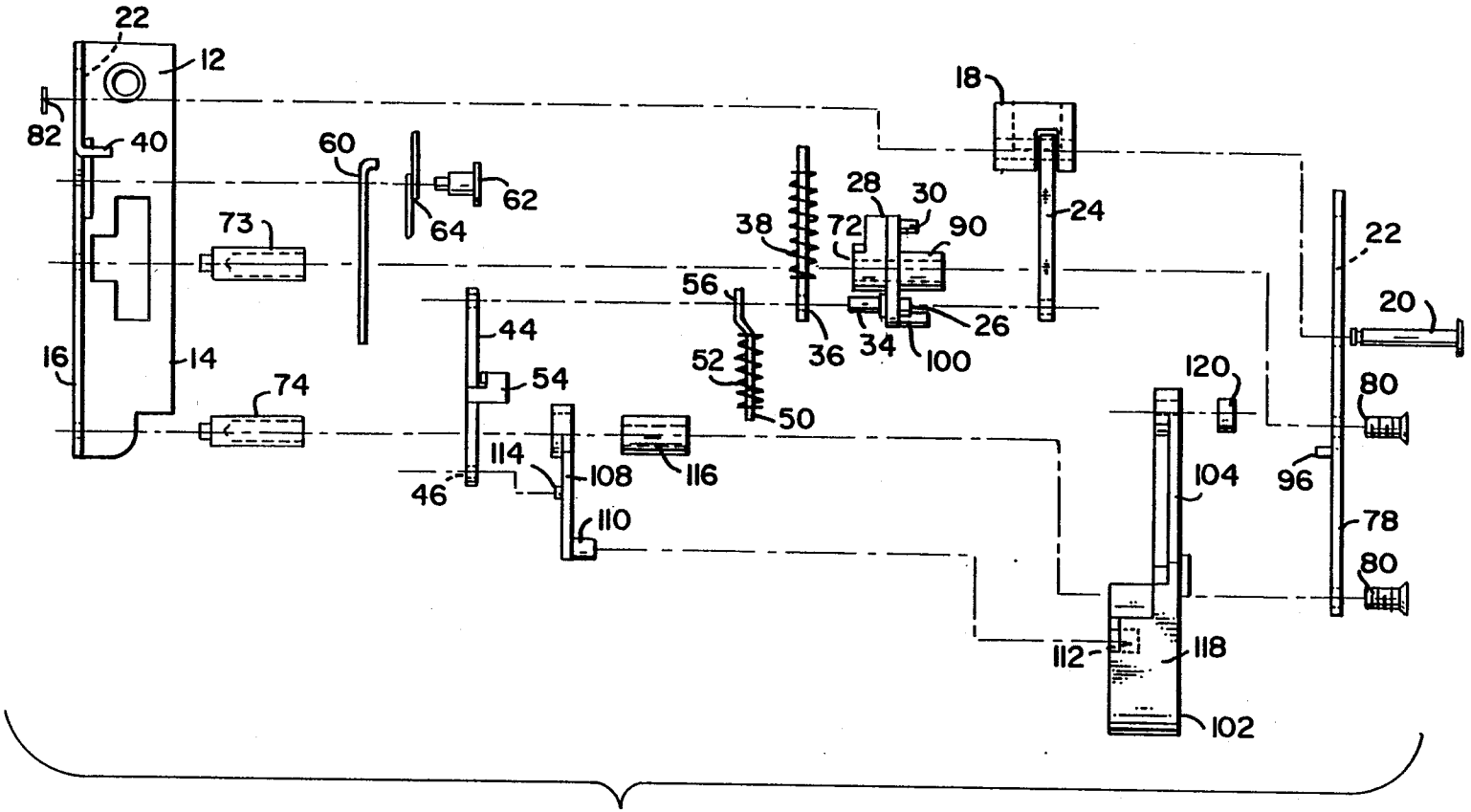
FIG. 3 is an exploded view of the bottom latch.

As shown in the figures, the universal assembly 10 comprises a platform 12 which has a base 14, a side wall 16, and a side plate 78. A rod connector 18 is slidably mounted on the platform 12 by means of a pin 20 which traverses a pair of slots 22 formed in the side wall 16 and side plate 78. A link 24 is also pinned via pin 20, at one end thereof; the other end of the link 24 is apertured to engage a pin 26 projecting from a rotary input member

28. Pin 26 is a "pull" pin, and the member 28 has another pin 30, the same being a "push" pin. That is, with link 24 engaged with pin 26, a rod 32 coupled to the connector 18 needs to be pulled to actuate the assembly, whereas if the link 24 were to be engaged with the pin 30, the rod would have to be pushed to actuate the assembly. The member 28 is journalled on a post 73 which, by means of a machine screw 80, is fixed in side plate 78 and side wall 16 in traverse of the platform 12. However, whether the link is joined to pin 26 or pin 30, the member 28 only rotates in the clockwise direction (as viewed in FIG. 1).

Member 28 has another pin 34 projecting therefrom, towards the wall 16, which receives the apertured end of an arm 36 which has a compression spring 38 thereabout. The other end of the arm 36 is secured in a lug 40 formed from, and bent right-angularly from, the side wall 16. The spring 38 bears against the lug 40, and a shoulder (not shown) adjacent the apertured end of the arm 36. Spring 38 urges the input member 28 in a counter-clockwise direction, and returns the member to the disposition shown in FIG. 1 after its operative rotation. A linkage subassembly 42 is also coupled to the pin 34. Linkage subassembly 42 comprises a limb 44 which has a termination with an aperture 46 formed therein, and an aperture 48 at the opposite end thereof; aperture 48 is engaged with the pin 34 of the input member 28. A spring guide 50, which has a compression spring 52 thereabout, is captured at one end thereof in a lug 54 which is integral with the limb; the other end of the guide 50 is also captured in another lug 56 which is pivotably journalled on the pin 34, between arm 36 and the opposite end of the limb 44. The compression spring 52 is constrained between the lugs 54 and 56, and it serves to keep the limb 44 away from the blocking arm (of which more is explained in the following).

The assembly 10 comprises means to insure that the rod 32 must be used (pulled, as shown, or pushed—if link 24 were engaged with the pin 30) to retract a latch bolt (58, in FIG. 2). The assembly 10 deadbolts by means of a blocking arm 60. Arm 60 is pivotably mounted to the side wall 16 by means of a rivet 62, and a torsion spring 64, which reacts from the base 14, holds the arm, resiliently, in the position thereof shown in FIG. 1. Now, limb 44 has a series of lands 66, 68 and 70 formed thereon. If a latch bolt (58, FIG. 2) is pushed into the platform, the arm 60 confronts and obstructs one of the lands. Consequently, the limb 44 cannot retract into the platform 12. The latch bolt is effectively deadbolted. If the rod 32 is used, however, the deadlocking or blocking arm is avoided.

Input member 28 has a cam 72 formed thereon, on the surface thereof, which confronts the wall 16. The arm 60 is held against the cam 72, but as the member 28 rotates, pursuant to the use of the rod 32, the cam 72 turns and displaces the arm 60. The arm 60 is displaced to a position, against the bias of the torsion spring 64, where, with the cooperation of the guide 50 and spring 52, it clears the limb 44. The member 28, in its rotation, also retracts the limb 44—and a latch bolt coupled thereto.

All the aforesaid description of the assembly 10 defines a universal unit which, by simply adding thereto respectively discrete parts or components of a top latch or a bottom latch, serves the operative functioning of either.

To form a top latch of assembly 10, a shaft 74 is fixed in traverse of the platform 12, and a latch bolt 58 apertured for journalling on the shaft, and having a pin 76 extending therefrom is used. Bolt 58 is journalled on the shaft 74, and secured by another machine screw 80 which is fastened into the shaft 74, and the pin 76 is set into the aperture earlier, pin 20 penetrates the slots 22 in wall 16 and in the side plate 78; a retaining ring 82 secures the pin 20 in place.

As built up from the universal assembly 10, the top latch also accommodates an auxiliary bolt 84. The auxiliary bolt 84 is slidably received on the base 14. It has a bifurcation the limbs 86 and 88 of which translate on a hub 90 of the input member 28. A compression spring 92 is confined in a slot 94 formed in the outermost side of the bolt 84, and held in place by the side plate 78. The spring 92 bears against the closed end of the slot 94, at one end thereof and is held at the opposite end by a lug 96 inturned from the plate 78. Spring 92, as will be appreciated, urges the bolt 84 to the left (as viewed in FIG. 4). However, it cannot yield to the spring 92 unless and until the input member 28 is rotated by the rod 32. On the side of the auxiliary bolt 84 which interfaces the member 28 is formed a dog-leg style trackway 98. The correspondingly interfacing side of the input member 28 has a pin 100 projecting therefrom which intrudes into the track way 98. When the input member is rotated, the pin 100 moves out of a captive portion of the trackway 98, and the auxiliary bolt is free to yield to the spring 92. Of course, with the rotation of the input member 28, the latch bolt 58 has been retracted. The trackway 98 has a sloped portion, and the pin 100 comes to rest against this portion; consequently, the input member is prevented from reverting to its normal, at rest, disposition. The latch bolt 58 is held retracted, and locked in its retraction; it cannot be pivoted outwardly.

In operation, the extended auxiliary bolt 84 closes against a strike and is pushed back into the platform 12. As it travels inwardly, it slides under the pin 100. Subsequently the pin 100 is free of the sloped portion of the trackway 98 and can move into the captive portion thereof—permitting the input member 28 to return to its at rest disposition, with the latch bolt 58 extended again.

With equal facility, the assembly 10 can be added thereto to form a bottom latch. A bottom latch bolt 102 has a bifurcation in which the limbs 104 and 106 thereof translate across the hub 90 of the input member 28. In this construction, the shaft 74 pivotably mounts one end of a limb 108. The other end of the limb has has a prominent follower 110 formed thereon. The latch bolt 102 has a trough 112 formed in the side thereof which faces the wall 16, and the follower 110 is slid ably engaged with the trough. Additionally, and intermediate the length thereof, the limb 108 has an extending pin 114. Pin 114 is engaged with the aperture 46 of limb 44. To facilitate the translation of the latch bolt 102, the shaft 74 also has a roller 116 journalled thereon to engage the land 118 of the bolt 102, and the limb 106 also has a roller 120 mounted thereon for rolling engagement with the base 14.

While I have described my invention in connection with specific embodiments thereof, it is to be clearly understood that this is done only by way of example and not as a limitation to the scope of my invention, as set forth in the objects thereof and in the appended claims.

I claim:

1. A universal assembly for top or bottom latches in vertical-rod exit devices comprising:

a platform;

an input member rotatably journalled on said platform;

a rod connector slidably supported on said platform for translation in opposite directions;

means linking said rod connector and said input member for causing rotation of said input member coincident with slidable movement of said rod connector;

a linkage subassembly coupled to said input member, and having means for operatively engaging a latch bolt, for moving such a latch bolt pursuant to coincident (a) rotation of said input member, and (b) movement of said subassembly; and means movably coupled to said platform for blocking movement of said subassembly in response to a movement of such an engaged latch bolt independent of rotation of said input member.

2. A universal assembly, according to claim 1, wherein:

said subassembly has a limb with a land formed thereon; and said blocking means comprises an arm having an end disposed for confronting and obstructing said land.

3. A universal assembly, according to claim 2, wherein:

said limb is pivotably coupled to said platform for movement thereof between a first position, for confronting and obstructing said land, as aforesaid, and a second position in which said end of said arm clears said land to permit movement of said subassembly; and including means disposed between said platform and said limb urging said limb to said first position; and means carried by said input member for displacing said arm to said second position coincident with rotation of said input member.

4. A universal assembly, according to claim 1, wherein:

said input member has first and second pins extending therefrom in spaced-apart locations;

said linking means is selectively engageable with either of said pins;

wherein engagement of said linking means with one of said pins causes rotation of said input member in response to a translation of said rod connector in one of said opposite directions; and engagement of said linking means with the other of said pins causes rotation of said input member in response to a translation of said rod connector in the other of said opposite directions.

5. A top latch for a vertical-rod exit device, comprising:

a platform;

an input member journalled on said platform for rotation between first and second rotary dispositions;

biasing means interposed between said input member and said platform restraining said input member in said first disposition;

a rod connector slidably supported on said platform for translation in opposite, push and pull directions;

a link attached at one end thereof to said rod connector, and for attachment at the other end thereof to said input member to cause rotation of said input member in response to translation of said rod connector;

a linkage subassembly coupled to said input member for movement coincident with rotation of said input member;

a shaft mounted in traverse of said platform; and a latch bolt pivotably mounted on said shaft; wherein said latch bolt and said subassembly have means cooperatively coupling said latch bolt to said subassembly to cause said latch bolt to move pursuant to rotation of said input member and movement of said subassembly; and said input member has means for the aforesaid attachment of said other end of said link thereto in a first location on said input member, in a first mode of operation, to cause said input member to rotate to said second disposition in response to movement of said rod connector in said push direction, and means for attachment of said other end of said link thereto in a second location on said input member, in a second mode of operation, to cause said input member to rotate to said second rotary disposition, in response to movement of said rod connector in said pull direction.

6. A top latch, according to claim 5, further including:

an auxiliary bolt slidably disposed on said platform, and having a given side thereof which confronts said input member; and means interposed between said auxiliary bolt and said plate for urging said auxiliary bolt outward from said platform; wherein said auxiliary bolt further has a trackway formed on said given side thereof; and said input member has means slidably engaging said trackway for preventing rotation of said input member, and pivoting of said latch bolt.

7. A bottom latch for a vertical-rod exit device, comprising:

a platform;

an input member journalled on said platform for rotation between first and second rotary dispositions;

biasing means interposed between said input member and said platform restraining said input member in said first disposition;

a rod connector slidably supported on said platform for translation in opposite, push and pull directions;

a link attached at one end thereof to said rod connector, and for attachment at the other end thereof to said input member to cause rotation of said input member in response to translation of said rod connector;

a linkage subassembly coupled to said input member for movement coincident with rotation of said input member;

a shaft mounted in traverse of said platform;

a latch bolt slidably supported on said platform; and a limb journalled on said shaft, at one end thereof, and engaged with said latch bolt at the other end thereof; and wherein said limb is pivotably coupled to said linkage subassembly; and said input member has means for the aforesaid attachment of said other end of said link thereto in a first location on said input member, in a first mode of operation, to cause said input member to rotate to said second disposition in response to movement of said rod connector in said push direction, and means for attachment of said other end of said link thereto in a second location on said input member, in a second mode of operation, to cause said input member to rotate to said second rotary disposition, in response to movement of said rod connector in said pull direction.

8. A bottom latch, according to claim 7, wherein:

said latch bolt has a trough formed therein; and said other end of said limb has a follower thereon which is slidably engaged with said trough.

9. A bottom latch, according to claim 7, further including:

a roller journalled on said shaft; and wherein said latch bolt has a land which engages said roller.

10. A bottom latch, according to claim 7, wherein:

said latch bolt has an extended limb with a roller journalled thereon; and said roller engages said platform.

11. A universal assembly for top or bottom latches, in vertical-rod exit devices, comprising:

a platform;

an input member journalled on said platform for rotation between first and second rotary dispositions;

biasing means interposed between said input member and said platform restraining said input member in said first disposition;

a rod connector slidably supported on said platform for translation in opposite, push and pull directions;

a link attached to one end thereof to said rod connector, and for attachment at the other end thereof to said input member to cause rotation of said input member in response to translation of said rod connector; and a linkage subassembly coupled to said input member for movement coincident with rotation of said input member; wherein said subassembly has means for engaging a latch bolt to cause movement of such latch bolt pursuant to rotation of said input member and movement of said subassembly; and said input member has means for the aforesaid attachment of said other end of said link thereto in a first location on said input member, in a first mode of operation, to cause said input member to rotate to said second disposition in response to movement of said rod connector in said push direction, and means for attachment of said other end of said link thereto in a second location on said input member, in a second mode of operation, to cause said input member to rotate to said second rotary disposition, in response to movement of said rod connector in said pull direction.

* * * * *